United States Patent [19]

Eisbein et al.

[11] 4,235,549

[45] Nov. 25, 1980

[54] DEVELOPING STATION FOR AN ELECTROSTATIC COPIER

[75] Inventors: Jürgen Eisbein; Kurt Moser, both of Gerlingen, Fed. Rep. of Germany

[73] Assignee: Develop Dr. Eisbein GmbH and Co., Fed. Rep. of Germany

[21] Appl. No.: 19,565

[22] Filed: Mar. 12, 1979

[30] Foreign Application Priority Data

Apr. 21, 1978 [DE] Fed. Rep. of Germany ..... 2817464

[51] Int. Cl.[3] ..... G03G 15/00

[52] U.S. Cl. ..... 355/3 DD; 118/657

[58] Field of Search ..... 355/3 DD; 118/647–651, 118/657, 658; 96/15 D

[56] References Cited

U.S. PATENT DOCUMENTS

| | | | |
|---|---|---|---|
| 3,380,437 | 4/1968 | Swyler | 118/650 |
| 4,142,165 | 2/1979 | Miyakawa et al. | 118/657 X |

*Primary Examiner*—R. L. Moses

*Attorney, Agent, or Firm*—Craig and Antonelli

[57] ABSTRACT

A developing station for an electrostatic copier which station includes a magnetic roller connected to a rotary drive and disposed within a stationary sleeve made of a non-magnetizable material. The magnetic roller is adapted to receive a powdered toner, especially a single-component toner along its outer circumference. The stationary sleeve and roller are disposed so that an area of the outer circumference of the stationary sleeve and roller is located opposite an image carrier or an intermediate image carrier which is transported through the developing station past the magnetic roller. At least an outer surface of the sleeve is formed of an electrically insulating material with an insert or covering of an electrically conducting material being provided in the area of the sleeve which is opposite the image carrier or the intermediate image carrier.

11 Claims, 5 Drawing Figures

DEVELOPING STATION FOR AN ELECTROSTATIC COPIER

The present invention relates to an electrostatic copier, and, more particularly, to a developing station for an electrostatic copier which developing station includes a magnetic roller connected to a rotary drive and disposed within a stationary sleeve of nonmagnetizable material with the roller being adapted to receive a powdered toner, especially a single-component toner, on its circumferential surface, a portion of which surface is located opposite an image carrier or intermediate image carrier transported past the roller.

In Offenlegungsschrift No. 23 13 297, a sleeve is proposed which is constructed of an electrically conductive material, that is, metal, with aluminum being the metal preferably used in practice. Since the peripheral surface of the sleeve must be smooth in order to permit the applied toner to readily migrate to the sleeve without becoming trapped, relatively expensive machining operations of the sleeve are required. Moreover, in this proposed construction, the overall apparatus is limited in terms of the maximum working speed, that is, with respect to the feed rates of the image carrier or intermediate image carrier since insufficient toner will be supplied if the feed rate is too high.

However, the magnetic roller itself cannot be driven at excessively high rotational speeds since such rotation would result in the development of inadmissibly high eddy currents within the sleeve which currents would not only produce a heating of the sleeve, but also an influencing of the potential on the sleeve thereby interfering with the image transfer. Thus, the supply of toner cannot be increased by using a magnetic roller driven at a higher speed and if the amount of toner must be increased, there is no alternative other than to use a magnetic roller with a larger diameter, that is, with more poles provided along the circumference of the roller. However, such proposal immediately results in higher manufacturing costs.

The aim underlying the present invention resides in providing a developing station whereby it is possible to increase the supply of toner without having to increase the diameter of the magnetic roller.

In accordance with one feature of the present invention, at least an outer surface of the sleeve consists of an electrically insulating material with an insert or covering of electrically conductive material being provided in an area of the sleeve which is opposite the image carrier or intermediate image carrier.

By virtue of the features of the present invention, it is possible to drive the magnetic roller at a higher rotational speed without the adverse effects of the generated eddy currents having a negative effect upon the potential of the toner since even when the sleeve is made of a metallic material, the insulating outer layer surface provides considerable electrical insulation between the toner and the sleeve whereby it then becomes possible to increase the supply of toner.

In order to increase the supply of toner without increasing the diameter of the magnetic roll, it is also possible in accordance with the present invention to provide an insert or cover which includes a guide surface which differs from the contour of the essentially cylindrical sleeve which guide surface runs at least approximately parallel to the opposite image carrier or intermediate image carrier. By this arrangement, an extended transfer zone is provided wherein the electrostatically charged areas of the image carrier or the intermediate image carrier remain in the vicinity of the toner particles retained on the sleeve. This creates a longer distance within which the toner can be supplied and results in the enablement of the increasing in the supply of toner without increasing the rotational speed of the magnetic roller or the diameter of the magnetic roller. Consequently, this measure may be advantageously applied even to sleeves made of electrically conductive material.

In accordance with a further feature of the present invention, the cover may be constructed as a screen. Since the powdered toner is constantly migrating circumferentially on the sleeve, such a construction permits a continuous screening of the toner which in turn prevents the toner from clumping or the like and any clumps which may have already been formed can readily be broken up. Additionally, any foreign bodies present in the toner can be kept out of the transfer zone provided such foreign bodies are of a size different from the size of the toner particles.

According to the present invention, the insert or cover is grounded and an auxiliary voltage is applied to a back side of the intermediate image carrier or image carrier with the back side being provided with a semiconducting material and with an auxiliary voltage also being applied to the insert or cover.

In accordance with still further features of the present invention, the cover or insert may be glued to the outside of the sleeve and the cover may have an approximately U-shaped cross-section with legs of the U-shape resting on the outside of the sleeve.

With the cover constructed as a screen, the screen may be mounted between two arms projecting outwardly from the sleeve and abut a circumferential surface of the sleeve in the central area.

According to the present invention, the sleeve may be made in the form of a section or profile with a guide surface which section or profile is made from an electrically conductive non-magnetizable material. The profile or section of the sleeve can be effected by way of an extrusion of the sleeve.

Accordingly, it is an object of the present invention to provide a developing station for an electrostatic copier which avoids, by simple means, shortcomings and disadvantages encountered in the prior art.

Another object of the present invention resides in providing a developing station for an electrostatic copier which enables an increasing in a supply of toner particles to a magnetic roller of the developing station without increasing the diameter of the magnetic roller.

Yet another object of the present invention resides in providing a developing station for an electrostatic copier which permits an increase in the supply of toner without increasing a rotational speed of the magnetic roller of the developing station.

A further object of the present invention resides in providing a developing station for an electrostatic copier wherein sleeves surrounding a magnetic roller of the developing station may be made of electrically conductive material.

A still further object of the present invention resides in providing a developing station for an electrostatic copier which insures a constant migrating of powdered toner particles on a circumferential sleeve surrounding a magnetic roller of the developing station.

Yet another object of the present invention resides in providing a developing station for an electrostatic copier which functions reliably under all operating conditions.

A further object of the present invention resides in providing a developing station for an electrostatic copier which is simple in construction and therefore inexpensive to manufacture.

These and other objects, features, and advantages of the present invention will become more apparent from the following description when taken in connection with the accompanying drawings which show, for the purposes of illustration only, several embodiments in accordance with the present invention, and wherein.

Figure 1:
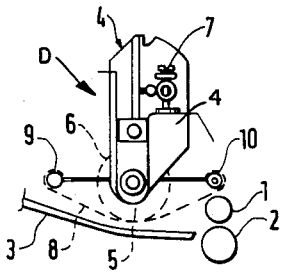
FIG. 1 is a schematic view of a developing station of an electrostatic copier in accordance with the present invention operating without an intermediate image carrier.

Referring now to the drawings wherein like reference numerals are used in both views to designate like parts and, more particularly, to FIG. 1, according to this figure, a developing station generally designated by the reference character D includes a pair of transport rollers 1, 2 for transporting an intermediate image carrier from an exposure station (not shown) of an electrostatic copier to a guiding plate 3 so that the intermediate image carrier is transported beneath a magnetic roller 5 of a toner transfer station generally designated by the reference numeral 4.

The toner transfer station 4 includes a supply container 4' for accommodating a quantity of dry toner which is dispensed to the magnetic roller and/or a sleeve 6 surrounding the magnetic roller 5. The magnetic roller 5 is mounted for rotation at the bottom of the container 4' and is connected to a drive means in a conventional manner for rotation, advantageously, in a direction opposite a direction of rotation of the transport 1, 2. The sleeve 6, which surrounds the magnetic roller 5 and carries the dry toner on its circumference, is disposed at the developing station in a stationary manner. The distance between the magnetic roller 5 and/or the sleeve 6 and the guide surface plate 3 and hence the distance to the image carrier guided over the guide surface 3 can be readily adjusted and set by way of an adjusting screw 7.

The image carrier may, for example, be a zinc-oxide-coated paper which has been given a uniform electrostatic charge at a previous station of the electrostatic copier and then having been partially discharged at an exposure station so that a charge pattern corresponding to the original to be copied results on the image carrier. The charged areas of the image carrier then receive toner from the toner station 4.

Preferably, a single-component toner is utilized which consists of small, largely uniform and homogeneous particles containing a magnetizable core. The toner particles are transferred under the influence of electric forces which develop between the charge pattern on the image carrier and the toner particles with the forces being sufficiently great so as to overcome the magnetic holding forces.

The guiding of the coated paper beneath the magnetic roller 5 on the guide plate 3 may be effected, for example, in the manner more fully described in U.S. Pat. No. 4,002,145. The subsequent fixing of the image to the carrier can be carried out in a manner more fully described in, for example, U.S. Pat. No. 4,022,122. Additionally, the drive for the magnetic roller 5 may be of a type disclosed in, for example, U.S. Pat. No. 3,976,371.

Figure 2:
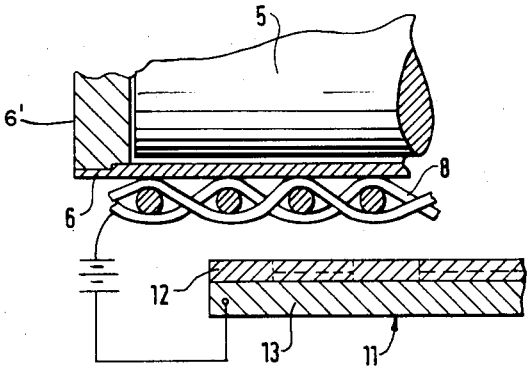
FIG. 2 is an axial partial cross-sectional view, on an enlarged scale, through a magnetic roller of the developing station of FIG. 1.

As shown most clearly in FIGS. 1 and 2, a screen 8, made of an electrically conductive material, covers the sleeve 6 in a circumferential area opposite the guiding surface plate 3. The screen 8 is supported by two supporting arms 9, 10 in such a manner that it is tensioned against the outer circumference of the sleeve 6 in the area which is at a minimum distance from the guide surface plate and/or the image carrier to be transported thereon with the screen 8 then curving away from the guide sheet in the areas before and after the area of minimum distance.

By mounting the screen 8 in the manner illustrated in FIG. 1, it is insured that the distance in which the toner can be transferred to the image carrier can be prolonged or extended despite the cylindrical shape of the sleeve 6. In this manner, the supply of toner can be increased simply so that the rate at which the image carrier can be fed through the electrostatic copier can be increased without increasing the diameter of the magnetic roller 5. The screen 8 also provides for a continuous screening of the toner circulating on the sleeve 6 so as to prevent a clumping or the like and, additionally, larger foreign bodies can be removed from the vicinity of the transfer zone.

Preferably, the sleeve 6 is made of an insulating material or constructed as a plastic sleeve; however, it is also possible to use a sleeve 6 made of aluminum with the sleeve 6 being provided with insulation along its outer surface as a result of the aluminum sleeve being anodized. The anodization of the sleeve 6 smooths the outer circumferential surface without requiring a costly mechanical machining. Additionally, the anodization produces a hard surface which will not be damaged by scratches or the like even after a long period of operation. With a sleeve 6 constructed of an insulating material or with an insulated outer surface, the rotational speed of the magnetic roller 5 can also be increased thereby resulting in an additional increase in the supply of toner.

As shown most clearly in FIG. 2, the sleeve 6 is mounted in a stationary position by way of two bearing flanges 6', only one of which is shown in the figure. As shown in FIG. 1, the screen 8 is located in the vicinity of the transfer zone with the screen 8 being made of an electrically conductive non-magnetizable material of, for example, aluminum, copper, or the like. In the transfer zone, the magnetic roller 5, sleeve 6, and screen 8 are located opposite an image carrier or opposite an intermediate image carrier generally designated by the reference numeral 11 (FIG. 2) which includes a semiconductor 12 and a base 13. The semiconductor 12 is provided with a charge pattern which corresponds to the original to be copied.

In the arrangement of FIG. 2, a so-called bias voltage is applied between the screen 8 and the semiconductor base 13 so that the screen 8 can therefore act as a form of control grid serving to intensify or reduce the depositing of the toner particles.

If the sleeve 6 is made of an electrically conductive material, and if a bias voltage is to be applied, the screen 8 must be insulated on one side. To accomplish such insulation in a simple manner, the screen 8 may be sprayed on one side with an insulating varnish.

Figure 3:
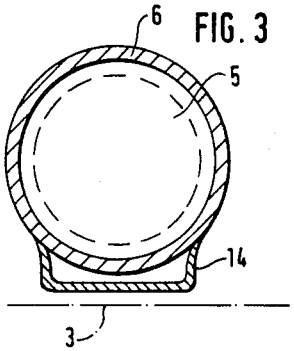
FIG. 3 is an axial cross-sectional view of another embodiment of a magnetic roller and sleeve of a developing station in accordance with the present invention.

As shown in FIG. 3, the sleeve 6 which surrounds the magnetic roller 5 has a cylindrical cross-section and is provided, in a vicinity of the transfer zone, that is, the zone opposite the guiding surface, with a cover 14 which can be in the form of a screen or an aluminum section. The cover has a U-shaped cross-sectional configuration and is mounted on the sleeve in such a manner that the legs of the cover abut the sleeve. The cover 14 is secured to the sleeve 6 by, for example, gluing or the like. Additionally, the cover 14 has a cross rib extending approximately tangentially to the sleeve 6 so as to extend the transfer zone. Advantageously, the cover 14 is grounded in a conventional manner.

Figure 4:
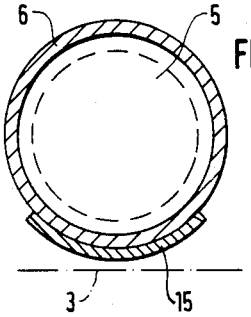
FIG. 4 is an axial cross-sectional view of a further embodiment of a magnetic roller and sleeve of a developing station in accordance with the present invention.

In FIG. 4, a thin sheet strip 15 made of an electrically conducting but non-magnetizable material is secured to the sleeve 6 by way of, for example, gluing or the like with the thin sheet strip surrounding at least a portion of the magnetic roller 5. The thin sheet strip 15 may be formed of, for example, sheet aluminum. The sheet strip 15 is secured to the sleeve 6 by way of, for example, gluing or the like. The sleeve 6 is constructed as an insulator or provided on the outside thereof with an insulating coating. For example, the sleeve 6 of FIG. 4 could be formed as an anodized aluminum sleeve. The sheet strip 15 may be grounded or a bias voltage, as shown in FIG. 2, can be applied to the sheet strip 15.

Figure 5:
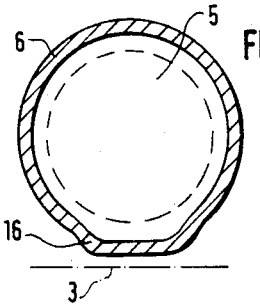
FIG. 5 is an axial cross-sectional view of yet another embodiment of a magnetic roller and sleeve of a developing station in accordance with the present invention.

As shown in FIG. 5, a magnetic roller 5 is surrounded by a sleeve 6 having a non-cylindrical profile. The sleeve 6 includes a flat area 16 extending approximately tangentially with respect to the cylindrical circumference of the sleeve 6. The flat area 16 is located in the area of the guide surface plate 3 or opposite an outside of an intermediate image carrier such as the image carrier 11. The sleeve 6 may be provided with the flat area 16 by extruding a section of aluminum or the like. The flat area 16 extends the transfer zone considerably without increasing the rotational speed of the magnetic roller 5 or necessitating an increase in the diameter of such roller.

While we have shown and described several embodiments in accordance with the present invention, it is understood that the same is not limited thereto, but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A developing station for an electrostatic copier, the developing station including a rotably driven magnetic roller disposed within a stationary sleeve formed of a non-magnetizable material, said magnetic roller being adapted to receive a powdered toner on an outer circumference thereof, said stationary sleeve being disposed so that an area of an outer circumference thereof is located opposited an image carrier or an intermediate image carrier transported through the developing station past the magnetic roller, characterized in that in the region of said sleeve that is opposite said image carrier or said intermediate image carrier, means are provided for deflection of the toner that is transported in the peripheral direction of said sleeve, whereby said toner in this region will have an increased radial distance with respect to the magnetic roll.

2. A developing station according to claim 1, characterized in that the means for deflection of said toner comprise electrically conductive material and said sleeve at least in its outer surface comprises electrically non-conductive material.

3. A developing station according to claim 2, characterized in that means are provided for applying an auxiliary voltage to a back side of said intermediate carrier or said image carrier and to said electrically conductive material, and in that the back side of said intermediate carrier or said image carrier is provided with a semiconducting material.

4. A developing station according to claim 2, characterized in that said sleeve is essentially cylindrical, said electrically conductive material forms a guide surface which bends away from a contour of said sleeve, said guide surface running at least approximately parallel to said intermediate image carrier or said image carrier.

5. A developing station according to claim 4, characterized in that the guide surface is constructed as an extruded profile projecting outwardly from said sleeve, said outwardly projecting profile being formed of an electrically conducting non-magnetizable material.

6. A developing station according to claim 2, characterized in that the electrically conductive means is constructed as a cover having a substantially U-shaped cross-sectional configuration including two inter-connected legs, and in that said cover is arranged so that said legs rest upon the outer circumference of said sleeve.

7. A developing station according to claim 2, characterized in that the electrically conductive material includes a screen.

8. A developing station according to claim 7, characterized in that means are provided for mounting said screen so that a portion thereof abuts said circumferential surface of said sleeve in a central area thereof.

9. A developing station according to one of claims 2, 3, or 6, characterized in that said electrically conductive material is glued to the outer circumference of said sleeve.

10. A developing station according to one of claims 2, 3, 5, 6, or 8, characterized in that said powdered toner is a single-component toner.

11. A developing station according to claim 2, characterized in that means are provided for grounding said electrically conductive material.

* * * * *